US010478941B2

(12) United States Patent
Yoon et al.

(10) Patent No.: US 10,478,941 B2
(45) Date of Patent: Nov. 19, 2019

(54) PAD CONDITIONER HAVING REDUCED FRICTION AND METHOD OF MANUFACTURING THE SAME

(75) Inventors: So Young Yoon, Seoul (KR); Joo Han Lee, Seongnam-si (KR); Jong Jae Lee, Suwon-si (KR)

(73) Assignee: EHWA DIAMOND IND. CO., LTD., Osan-si (KR)

( * ) Notice: Subject to any disclaimer, the term of this patent is extended or adjusted under 35 U.S.C. 154(b) by 1219 days.

(21) Appl. No.: 13/081,981

(22) Filed: Apr. 7, 2011

(65) Prior Publication Data

US 2011/0250826 A1 Oct. 13, 2011

(30) Foreign Application Priority Data

Apr. 8, 2010 (KR) ..... 10-2010-0032258

(51) Int. Cl.

| | |
|---|---|
| ***B24B 53/12*** | (2006.01) |
| ***B24D 18/00*** | (2006.01) |
| ***B24D 3/00*** | (2006.01) |
| ***B24B 53/017*** | (2012.01) |

(52) U.S. Cl.
CPC ..... *B24B 53/017* (2013.01)

(58) Field of Classification Search
USPC ..... 451/443, 56, 285
See application file for complete search history.

(56) References Cited

U.S. PATENT DOCUMENTS

| | | | | |
|---|---|---|---|---|
| 5,190,568 | A * | 3/1993 | Tselesin | 51/293 |
| 5,921,856 | A * | 7/1999 | Zimmer | 451/539 |
| 6,213,856 | B1 * | 4/2001 | Cho et al. | 451/443 |
| 6,286,498 | B1 * | 9/2001 | Sung | 125/12 |
| 6,500,054 | B1 * | 12/2002 | Ma et al. | 451/56 |
| 6,719,615 | B1 * | 4/2004 | Molnar | 451/41 |
| 6,852,016 | B2 * | 2/2005 | Henderson | 451/56 |
| 7,066,795 | B2 * | 6/2006 | Balagani et al. | 451/285 |
| 7,226,345 | B1 * | 6/2007 | Dornfeld et al. | 451/285 |
| 8,104,464 | B2 * | 1/2012 | Sung | 125/12 |
| 8,393,938 | B2 * | 3/2013 | Sung | 451/443 |
| 2002/0127962 | A1 * | 9/2002 | Cho et al. | 451/443 |
| 2003/0084894 | A1 * | 5/2003 | Sung | 125/12 |
| 2003/0114094 | A1 * | 6/2003 | Myoung et al. | 451/443 |

(Continued)

FOREIGN PATENT DOCUMENTS

| | | | |
|---|---|---|---|
| JP | 2003-053665 | A | 2/2003 |
| KR | 10-2010-0033911 | A | 3/2010 |
| KR | 2010-0138737 | A | 12/2010 |

OTHER PUBLICATIONS

Koizumi et al., Physics and Applications of CVD Diamond, 2008, Wiley, attached pages "Physics and Applications of CVD diamond. PDF".*

(Continued)

*Primary Examiner* — Marc Carlson
(74) *Attorney, Agent, or Firm* — Stein IP, LLC

(57) ABSTRACT

This invention relates to a conditioner for a chemical mechanical planarization pad, which is necessary for global planarization of a wafer in order to increase the degree of integration of a semiconductor device, and more particularly to a pad conditioner having a structure able to reduce friction with a pad so as to solve the problems caused by a lot of friction being generated upon conditioning, and to a method of manufacturing the same.

6 Claims, 16 Drawing Sheets

(56) References Cited

U.S. PATENT DOCUMENTS

| | | | | |
|---|---|---|---|---|
| 2004/0072510 | A1* | 4/2004 | Kinoshita et al. | 451/56 |
| 2005/0118939 | A1* | 6/2005 | Duescher | 451/527 |
| 2005/0227590 | A1* | 10/2005 | Sung | 451/41 |
| 2005/0276979 | A1* | 12/2005 | Slutz et al. | 428/408 |
| 2006/0128288 | A1* | 6/2006 | An et al. | 451/444 |
| 2006/0199482 | A1* | 9/2006 | Moon et al. | 451/285 |
| 2006/0258276 | A1* | 11/2006 | Sung | 451/527 |
| 2007/0128994 | A1* | 6/2007 | Sung | 451/540 |
| 2007/0197142 | A1* | 8/2007 | Sung | 451/56 |
| 2007/0209287 | A1* | 9/2007 | Chen et al. | 51/307 |
| 2007/0254566 | A1* | 11/2007 | Sung | 451/443 |
| 2007/0259609 | A1* | 11/2007 | Iiyoshi et al. | 451/443 |
| 2008/0014845 | A1* | 1/2008 | Yilmaz et al. | 451/443 |
| 2008/0146128 | A1* | 6/2008 | Shirasu | 451/443 |
| 2008/0153398 | A1* | 6/2008 | Sung | 451/56 |
| 2009/0224370 | A1* | 9/2009 | Slutz | 257/618 |
| 2010/0003904 | A1* | 1/2010 | Duescher | 451/259 |
| 2010/0330885 | A1 | 12/2010 | Schwandner | 451/44 |
| 2012/0115402 | A1* | 5/2012 | Wu et al. | 451/443 |

OTHER PUBLICATIONS

Godbole et al., Evidence for layered growth of (100) textured diamond films, 1997 "Layered Growth of CVD Diamond.PDF".*

Silva et al., Geometric modeling of homoepitaxial CVD diamond growth, 2007 "Geometric modeling of homoepitaxial CVD diamond growth.PDF".*

Korean Office Action dated May 2, 2011, issued in corresponding Korean Application, KR 10-2010-0032258.

* cited by examiner

[Fig. 1]
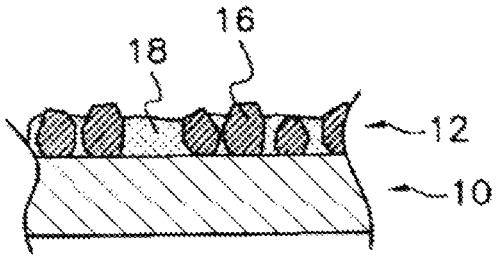
[Fig. 2]
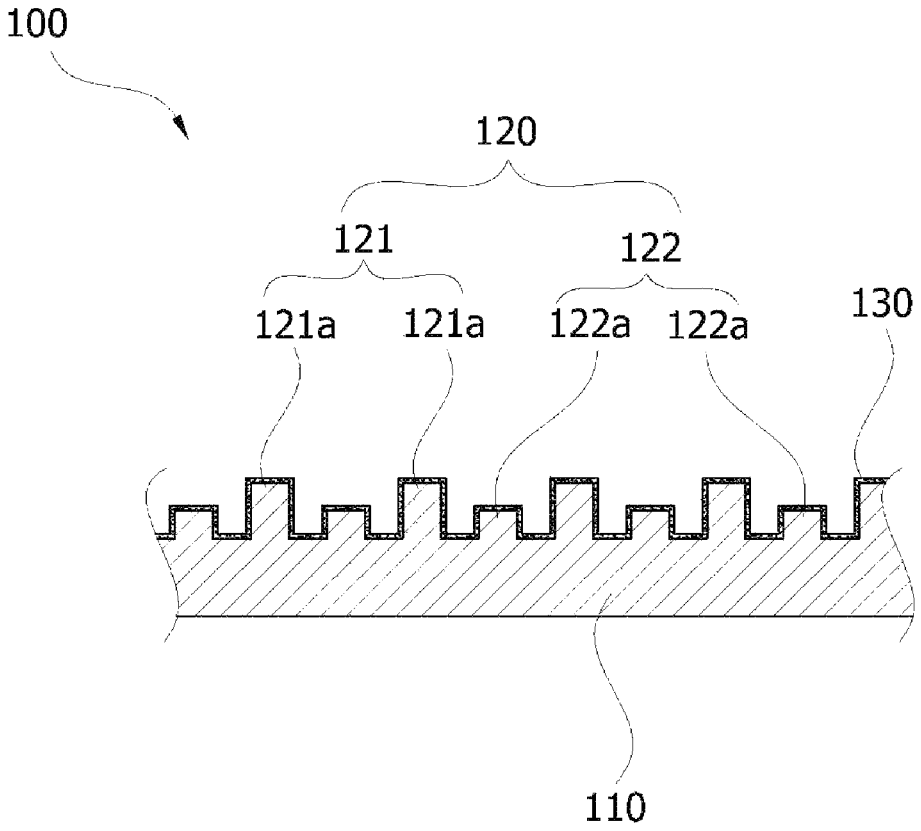

[Fig. 3]
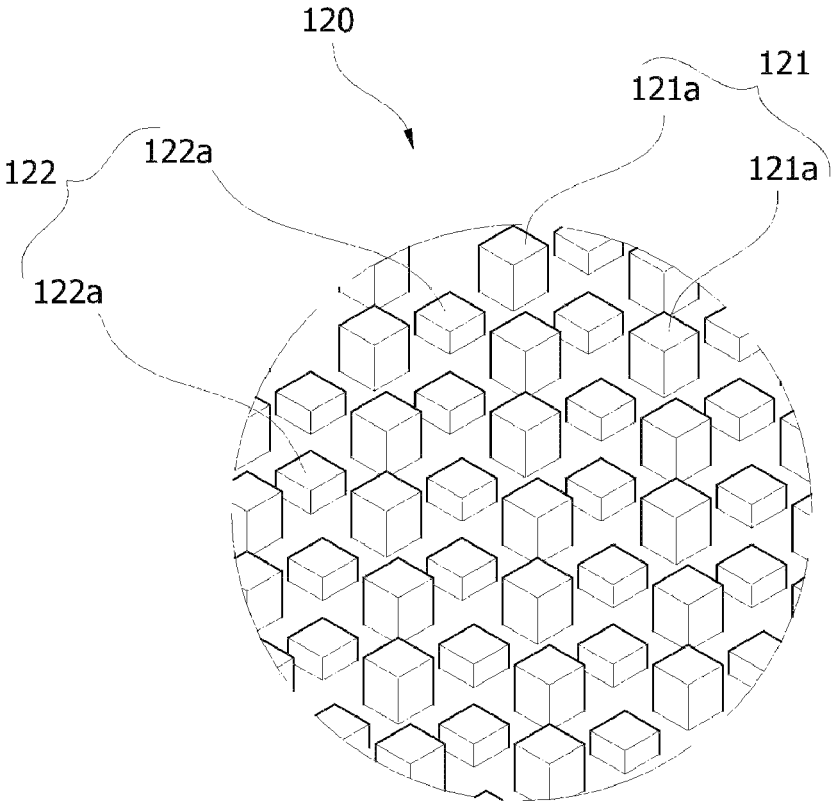

[Fig. 4]
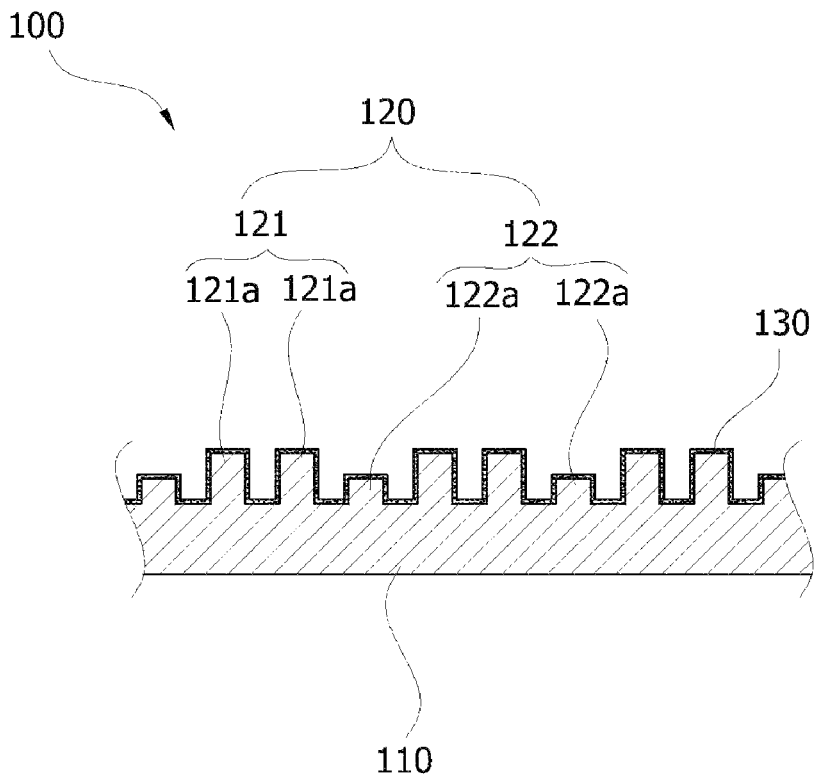

[Fig. 5]
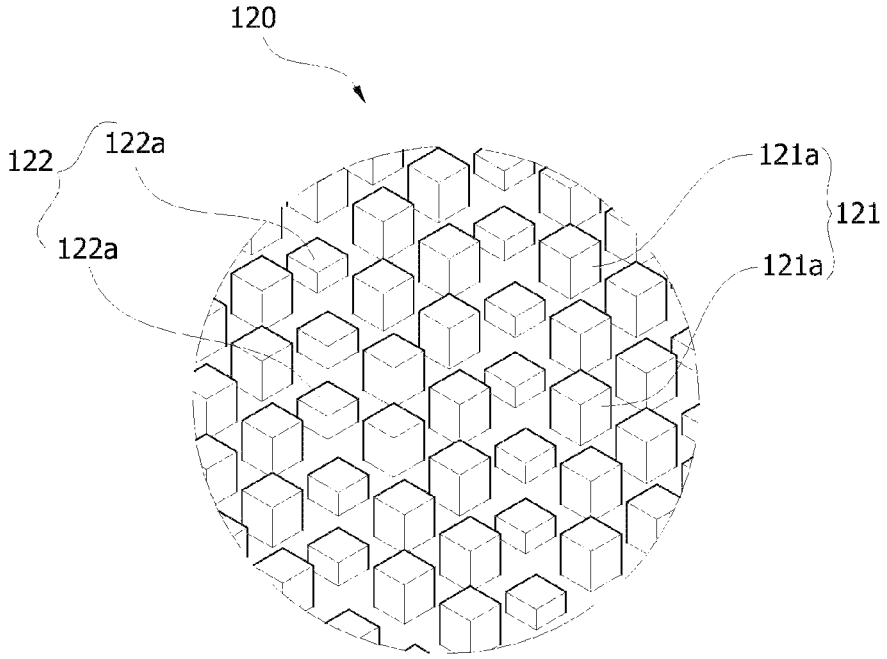

[Fig. 6]
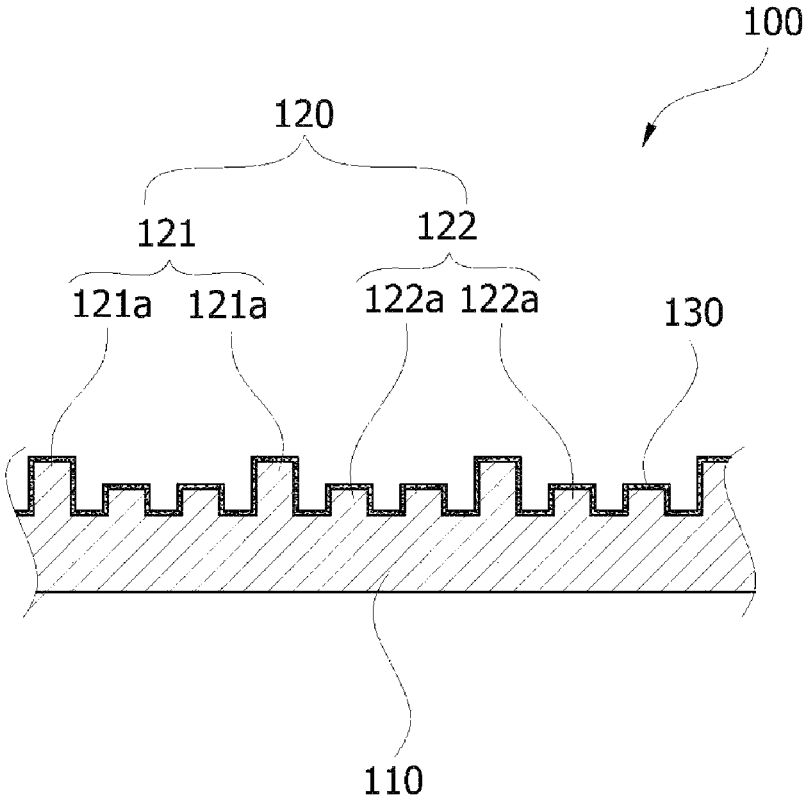

[Fig. 7]
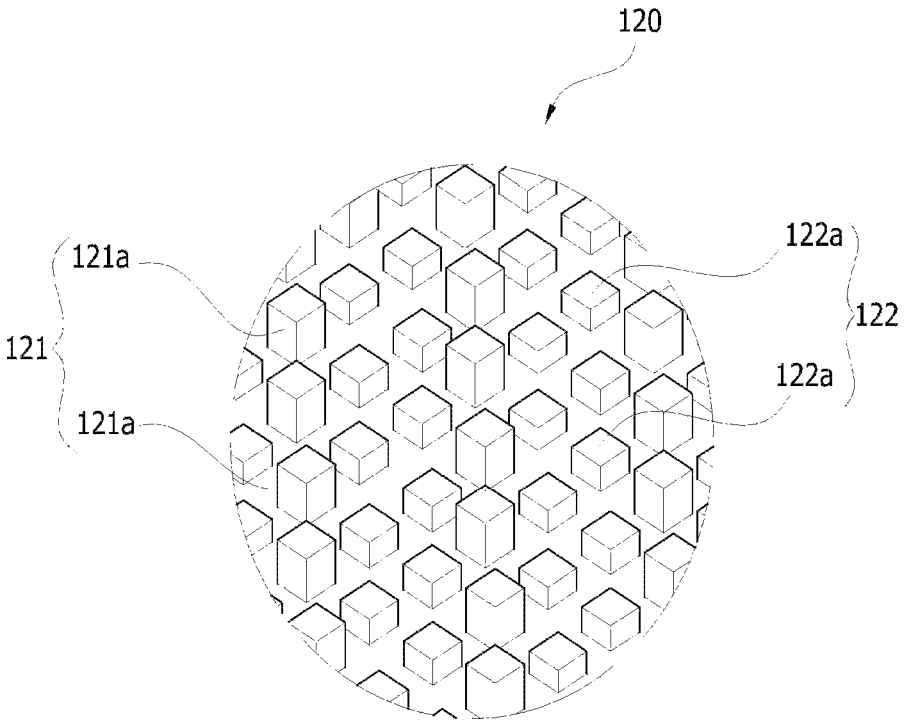

[Fig. 8]
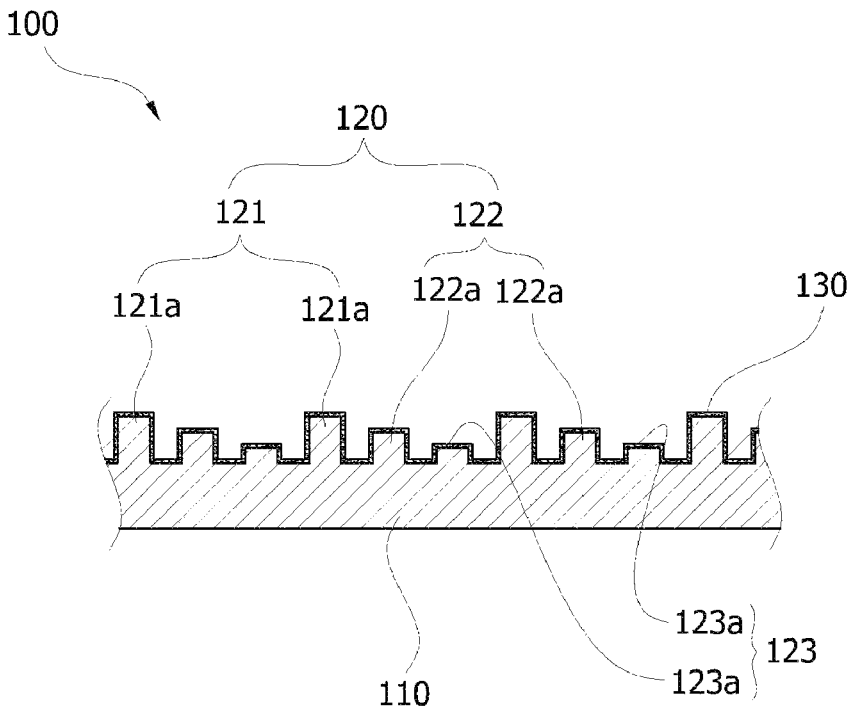

[Fig. 9]
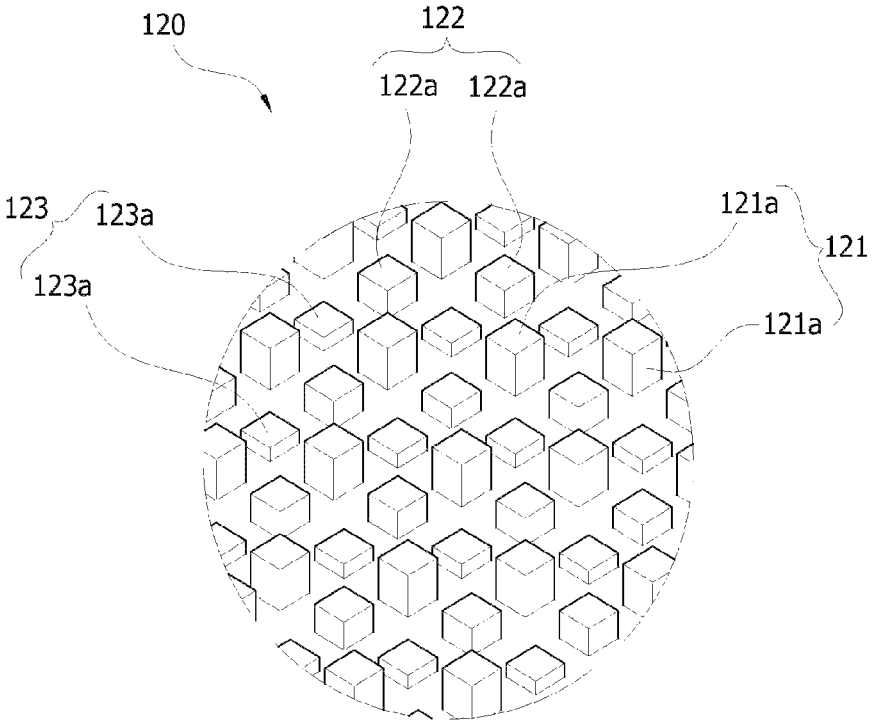

[Fig. 10]
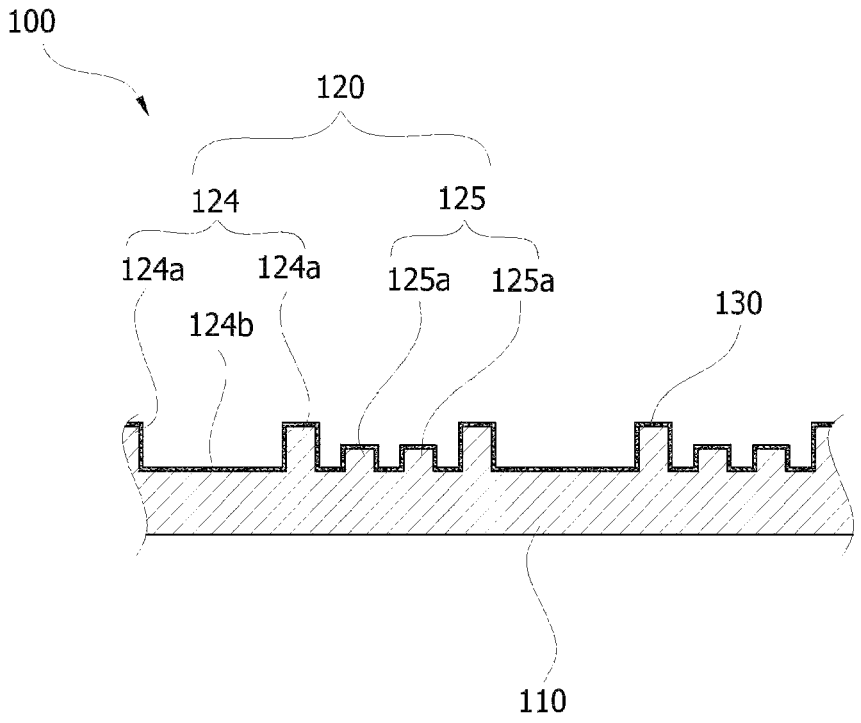

[Fig. 11]
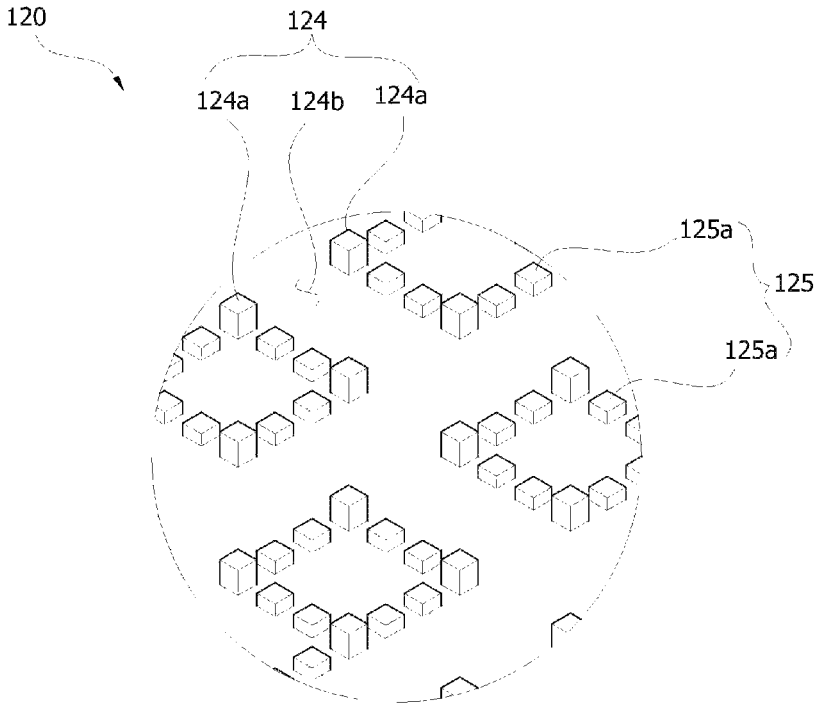

[Fig. 12]
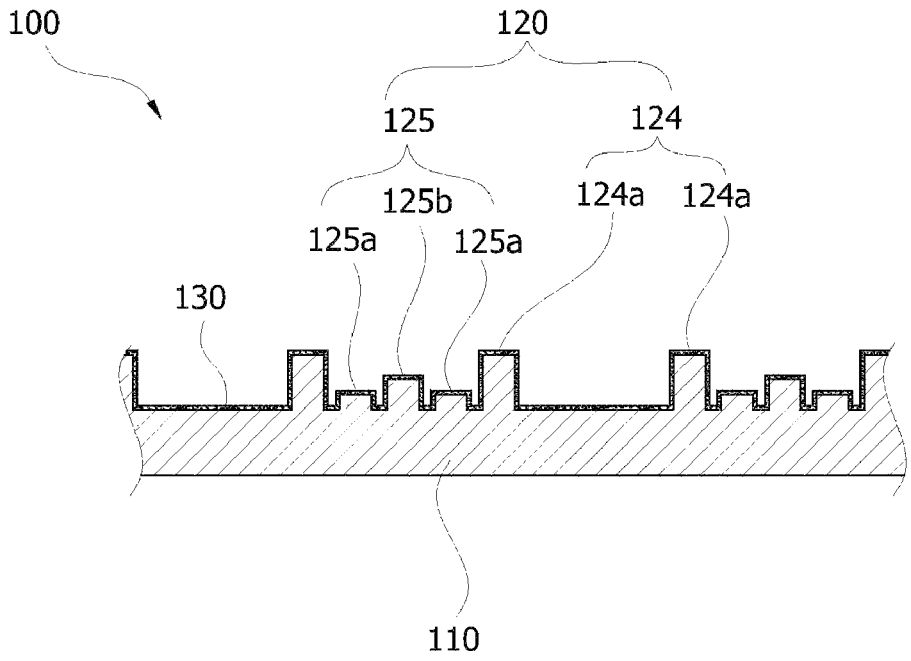

[Fig. 13]
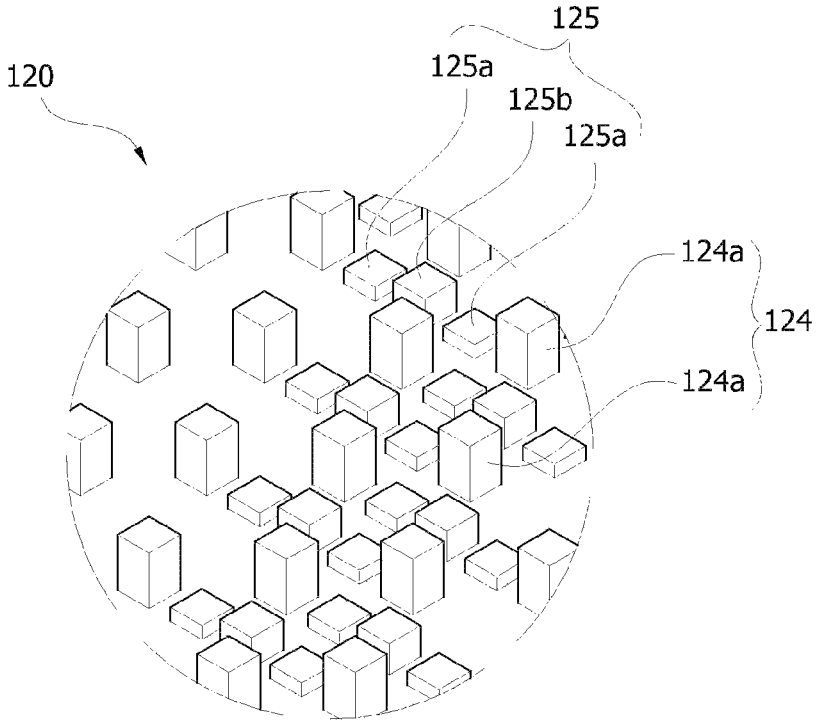

[Fig. 14]
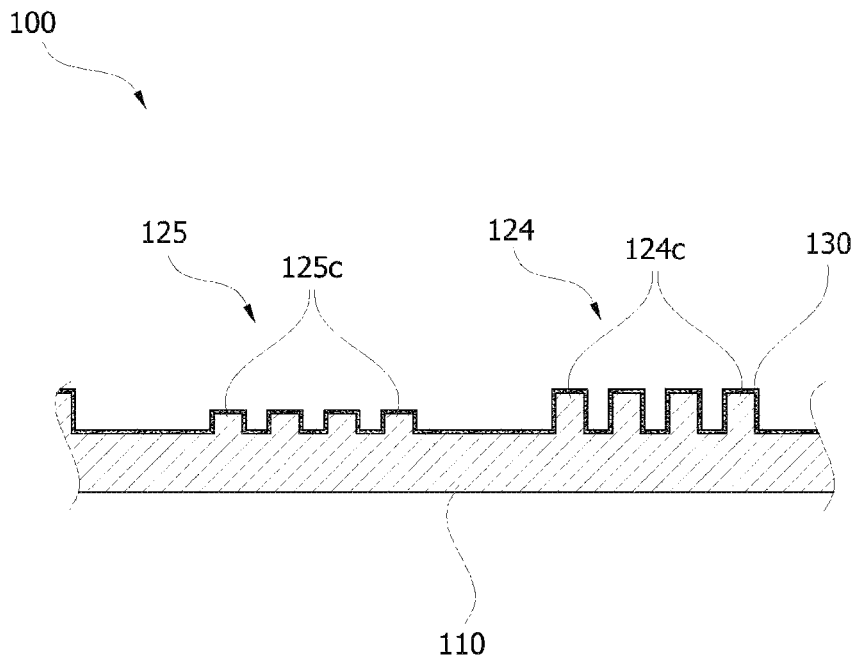

[Fig. 15]
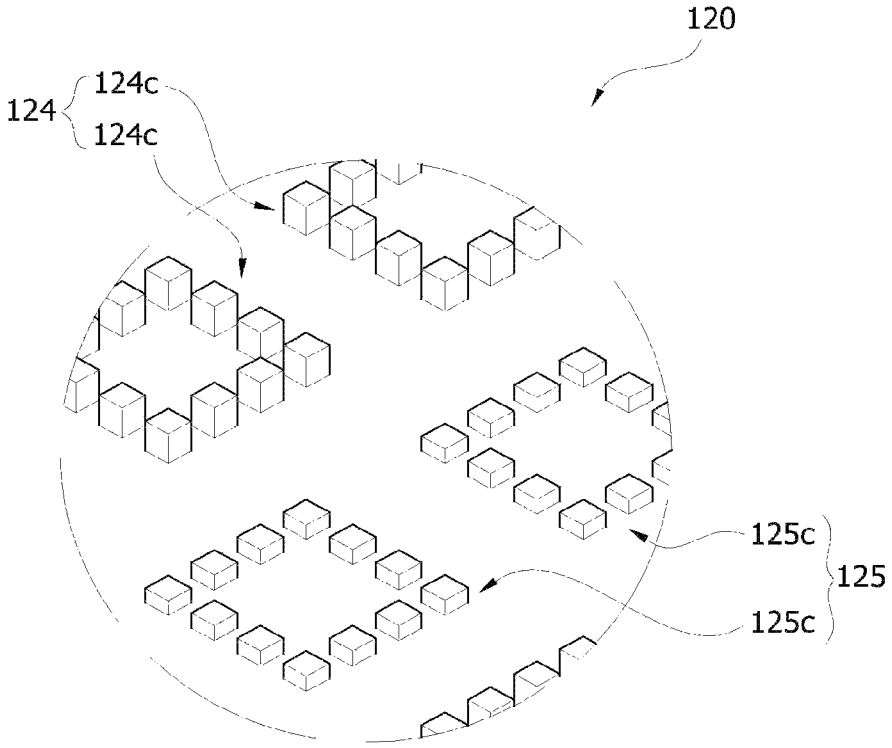

[Fig. 16]
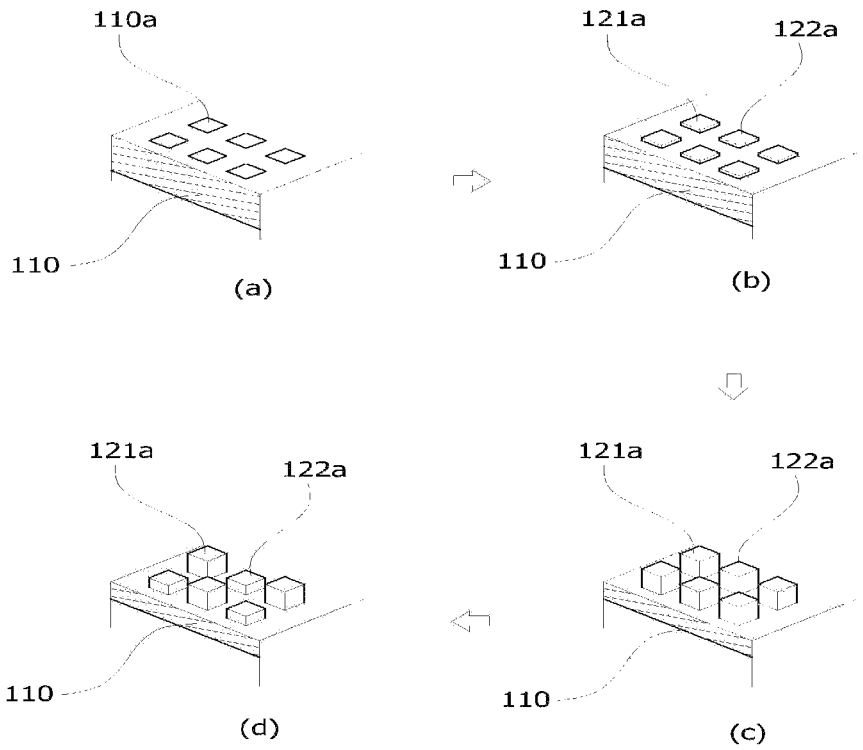

[Fig. 17]
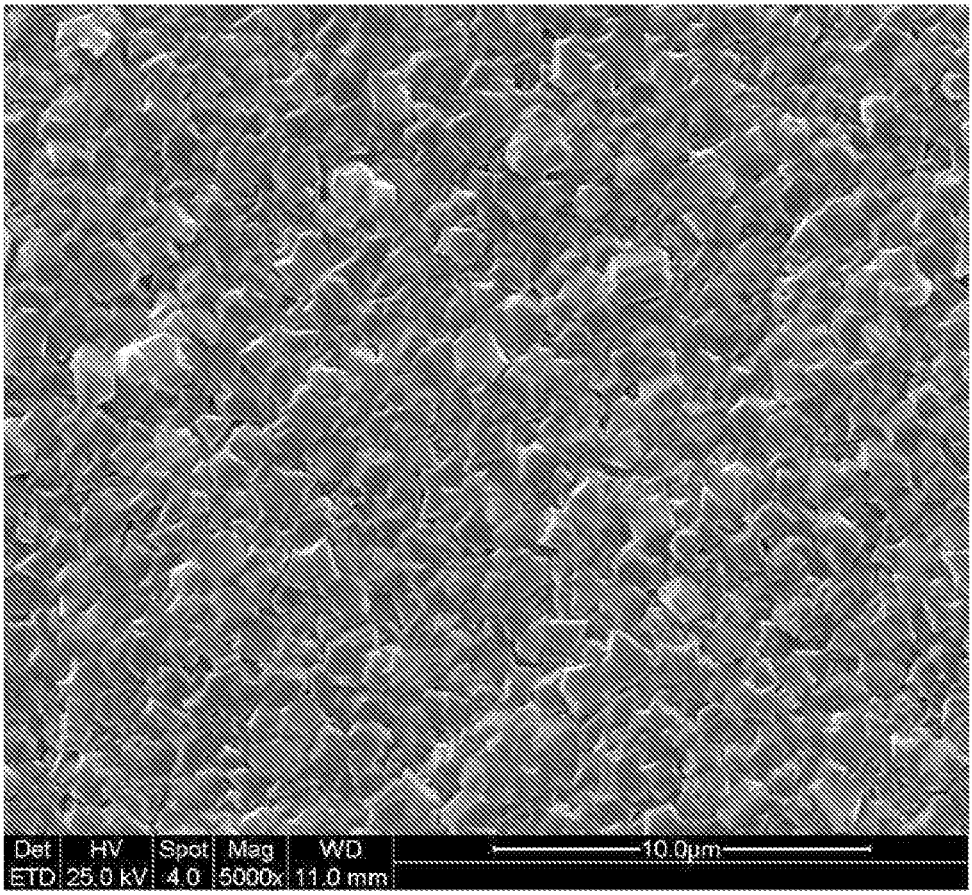

PAD CONDITIONER HAVING REDUCED FRICTION AND METHOD OF MANUFACTURING THE SAME

BACKGROUND OF THE INVENTION

1. Technical Field

The present invention relates to a conditioner for a chemical mechanical planarization pad, which is necessary to do global planarization of a wafer in order to increase the degree of integration of a semiconductor device, and more particularly to a pad conditioner having a structure able to reduce friction with a pad so as to solve the problems caused by a lot of friction being generated upon conditioning, and to a method of manufacturing the same.

2. Description of the Related Art

Recently, CMP (Chemical Mechanical Polishing) techniques have been essential in processes of manufacturing semiconductor devices because of the microstructures and multilayered structures of semiconductor devices. CMP techniques, which are a polishing process that is mainly used in the planarization of a wafer during a semiconductor fabrication process, are currently utilized for the planarization of interlayer insulating films and also for various processes including for example Cu wiring and device separation.

Specifically, the planarization process using CMP is performed in such a manner that a polishing pad is attached onto a platen which rotates and a wafer which is to be polished is held by means of a carrier, and while a slurry is supplied onto the pad, the platen and the carrier are subjected to relative motion in a state of pressure being applied to the carrier that holds the wafer, thus polishing the wafer.

Thus, in the CMP planarization process, the uniformity of a removal rate (i.e. polishing uniformity) across the surface of a workpiece such as a wafer is regarded as important. In order to increase the polishing uniformity, it is important that any factor which affects the removal rate across the surface of the workpiece be uniformly distributed. Such an important factor includes the polishing pressure and the relative rate upon polishing; the surface state of the polishing pad may also be included as an important quantitative factor.

Specifically, the polishing pad has numerous small pores having a diameter of about 30~70 μm formed on the surface thereof so as to hold slurry, and thus may exhibit pumping effects when pressure is applied to the workpiece, thereby increasing the polishing efficiency in terms of the removal rate. However, as the polishing process progresses, the small pores of the polishing pad become worn and become clogged by the remnants of polishing, and the polishing pad itself may become worn, undesirably decreasing the flatness of the polishing pad.

The preferred surface state of the polishing pad may be achieved by conditioning the polishing pad, including cutting the surface of the deformed pad using a conditioner, in order to restore the worn or clogged pores of the polishing pad and the decreased flatness of the polishing pad to its original state.

Hence, the conditioning process enables the surface state of the polishing pad to be optimized to an initial state with a high ability to hold slurry, using a pad conditioner having a grinder such as diamond which comes into contact with the polishing pad to scrape or rub the surface of the polishing pad, or this process functions to restore the ability of the polishing pad to hold slurry so that the polishing ability of the polishing pad can be maintained.

An example of the pad conditioner used to process and adjust the polishing pad includes an electroplated diamond conditioner, typically suitable for use when conditioning a polishing pad. With reference to FIG. 1 which shows an enlarged view of the structure near the surface of the diamond conditioner, this conditioner includes an electroplated diamond disk obtained by sprinkling diamond particles 16 onto a main body 10 made of stainless steel and electroplating the diamond particles 16 with a metal 18 such as nickel, or a brazed diamond disk obtained by fusing a metal 18 so that diamond particles 16 are fixed. Such an electroplating or brazing process is problematic because the diamond particles 16 are irregularly distributed and have different sizes, and thus the surface height of the cutter 12 is not uniform, undesirably roughening the surface of the conditioned polishing pad.

With the goal of solving such problems, Korean Patent No. 10-0387954 discloses a CVD pad conditioner comprising a substrate having a plurality of truncated polypyramids protruding upwards at a uniform height from the surface of the substrate and a diamond layer deposited thereon using CVD.

However, the CVD pad conditioner is disadvantageous because the surface of the substrate thereof applies a predetermined load to the surface of the pad which is rotating around an axis, and thereby the rotating motion of the substrate takes place in accordance with the rotating motion of the pad, and the surface of the pad (which is a conditioning target) should be processed and adjusted by means of the cutting tip comprising the truncated polypyramids inserted into the surface of the pad, thus relatively increasing the friction between the conditioner and the polishing pad upon conditioning, undesirably causing vibrations.

Furthermore, in the CVD pad conditioner, the truncated polypyramids which are the cutting tip are formed separated by a distance of 0.5~5 mm, and thus the distance between the polypyramids which are the cutting tip is wider compared to the conditioner as shown in FIG. 1, undesirably making it difficult to uniformly disperse (develop) slurry particles which are supplied onto the polishing pad upon polishing.

SUMMARY OF THE INVENTION

Culminating in the present invention, intensive and thorough research was carried out by the present inventors aiming to solve the problems encountered in the related art.

Accordingly, an object of the present invention is to provide a pad conditioner which has a structure able to reduce friction upon conditioning, thus extending the lifespan of a polishing pad.

Another object of the present invention is to provide a pad conditioner which is able to uniformly develop slurry particles supplied onto a polishing pad, thus decreasing scratching due to the flocculation of the slurry.

A further object of the present invention is to provide a pad conditioner which has a structure able to ensure surface uniformity of a polishing pad upon conditioning, thus improving the quality of a workpiece that is processed by the polishing pad.

Still a further object of the present invention is to provide a method of manufacturing a pad conditioner, which increases dimensional reproducibility of the pad conditioner thus reducing defective rates, and also increases the manufacturing rate, resulting in high productivity.

The objects of the present invention are not limited to the above objects, and the other objects which are not mentioned herein will be apparently understood by those skilled in the art from the following description.

An aspect of the present invention provides a pad conditioner having reduced friction, comprising a substrate having a plurality of protrusions having different heights which are formed upwards and separated from each other by the same distance on part or all of one surface of the substrate, tops of the protrusions forming a plane parallel to the surface of the substrate; and a diamond layer applied on the plurality of protrusions or on the entire surface having the protrusions.

In this aspect, the plurality of protrusions may comprise a first height group comprising a plurality of first protrusions having a first height and a second height group comprising a plurality of second protrusions having a second height, in which the second height is lower than the first height.

In this aspect, each of the second protrusions of the second height group may be formed such that the second protrusion is disposed between a pair of first protrusions of the first height group in any direction.

In this aspect, each of the second protrusions of the second height group may be formed such that the second protrusion is disposed between two pairs of first protrusions of the first height group in any direction.

In this aspect, each of the first protrusions of the first height group is formed such that the first protrusion is disposed between two pairs of second protrusions of the second height group in any direction.

In this aspect, the plurality of protrusions may comprise a first height group comprising a plurality of first protrusions having a first height, a second height group comprising a plurality of second protrusions having a second height, and a third height group comprising a plurality of third protrusions having a third height, in which the second height is lower than the first height and the third height is lower than the second height.

In this aspect, each of the second protrusions of the second height group and each of the third protrusions of the third height group may be formed such that the second protrusion and the third protrusion are disposed between a pair of first protrusions of the first height group in any direction.

In this aspect, a difference between the first height and the second height may be 10~70 μm.

In this aspect, the plurality of protrusions may be formed separated by a distance of 0.1~2.5 mm.

Another aspect of the present invention provides a pad conditioner having reduced friction, comprising a substrate having a plurality of protrusions having different heights which are formed separated from each other on part or all of one surface of the substrate, tops of the protrusions forming a plane parallel to the surface of the substrate; and a diamond layer applied on the plurality of protrusions or on the entire surface having the protrusions.

In this aspect, the plurality of protrusions may comprise a high height group comprising a plurality of high protrusions having a maximum first height and separated from each other by same separation spaces, and a low height group comprising low protrusions having a height lower than the first height formed in all or parts of the separation spaces between the high protrusions of the high height group, in which six or fewer low protrusions having same or different heights per separation space are formed separated from each other.

In this aspect, the plurality of high protrusions may be formed separated by a distance of 0.5~5.0 mm.

In this aspect, when the low height group formed per separation space comprises three or five low protrusions having different heights, the low protrusions of the low height group may form a protruding contour in which a center is high and both sides are low.

In this aspect, the plurality of protrusions may comprise a high height group comprising a plurality of high protrusions having a maximum first height and a low height group comprising a plurality of low protrusions having same or different heights lower than the first height, and the high height group and the low height group may provide a plurality of unit groups each comprising two or more protrusions which are separated from each other, in which the plurality of unit groups may be formed such that one or more high height unit groups and one or more low height unit groups are alternately disposed.

In this aspect, each of the plurality of low height unit groups of the low height group may comprise low protrusions having the same height.

In this aspect, the protrusions may have any one shape among a truncated polypyramid, a truncated cone, a polyprism, and a cylinder.

In this aspect, the surface of the substrate on which the plurality of protrusions are formed (not shown in the Figures) may be selected from the group consisting of i) one surface of a polygonal flat panel type substrate or a disk type substrate, ii) an outer periphery of a U-shaped substrate, which is higher than an inner lower surface, iii) one surface of an angled doughnut-shaped substrate, and iv) a segment surface of a segment substrate in which one surface of the U-shaped substrate or the angled doughnut-shaped substrate is divided into a plurality of segments.

In this aspect, the diamond crystalline structure of the diamond layer may have a (1,0,0) growth plane.

In this aspect, the diamond layer may be deposited using CVD under conditions including a filament temperature of 1900~2000° C. and a substrate temperature of 1000~1100° C.

A further aspect of the present invention provides a method of manufacturing the above pad conditioner, comprising preparing a substrate; forming a plurality of protrusions having a uniform height and separated from each other by a predetermined distance on a surface of the substrate, tops of the protrusions forming a plane parallel to the surface of the substrate; polishing the plurality of protrusions having the uniform height in a predetermined pattern so that the plurality of protrusions have different heights; and coating the surface of the substrate having the plurality of protrusions having different heights with a diamond layer.

In this aspect, forming the plurality of protrusions may be performed using etching and any one among a cutting wheel, an end mill, a milling cutter, a drill and a tap, or using etching or any one among a cutting wheel, an end mill, a milling cutter, a drill and a tap, polishing the plurality of protrusions may be performed using any one among a cutting wheel, an end mill, a milling cutter, a drill and a tap, and coating may be performed using CVD.

In this aspect, etching may comprise subjecting portions of the surface of the substrate on which the plurality of protrusions will be formed to photolithography and then forming part of all of a height of the protrusions separated from each other using etching, and may further comprise, when part of the height of the protrusions is formed, forming the remaining height of the protrusions using any one among a cutting wheel, an end mill, a milling cutter, a drill and a tap.

In this aspect, when part of the height of the protrusions is formed, the height of the protrusions formed using etching may be 1~50% of a total height (h).

In this aspect, subjecting at least one surface of the substrate to precise grinding and lapping may be performed, before forming the protrusions.

In this aspect, the diamond layer may comprise a microcrystalline diamond coating layer having a thickness of 70~90% of a total thickness and a nanocrystalline diamond coating layer having a thickness of 10~30% which is a remainder of the total thickness formed on an upper surface of the microcrystalline diamond coating layer.

BRIEF DESCRIPTION OF THE DRAWINGS

The features and advantages of the present invention will be more clearly understood from the following detailed description taken in conjunction with the accompanying drawings, in which:

FIG. 1 is an enlarged cross-sectional view showing a structure near the surface of the cutter of a conventional electroplated diamond conditioner;

FIG. 2 is an enlarged cross-sectional view showing the structure of the cutting tip of the cutter of a pad conditioner 1 of Example 1 according to the present invention;

FIG. 3 is an enlarged perspective view showing the surface structure of the cutting tip of the pad conditioner 1 of FIG. 2;

FIG. 4 is an enlarged cross-sectional view showing the structure of the cutting tip of the cutter of a pad conditioner 2 of Example 2 according to the present invention;

FIG. 5 is an enlarged perspective view showing the surface structure of the cutting tip of the pad conditioner 2 of FIG. 4;

FIG. 6 is an enlarged cross-sectional view showing the structure of the cutting tip of the cutter of a pad conditioner 3 of Example 3 according to the present invention;

FIG. 7 is an enlarged perspective view showing the surface structure of the cutting tip of the pad conditioner 3 of FIG. 6;

FIG. 8 is an enlarged cross-sectional view showing the structure of the cutting tip of the cutter of a pad conditioner 4 of Example 4 according to the present invention;

FIG. 9 is an enlarged perspective view showing the surface structure of the cutting tip of the pad conditioner 4 of FIG. 8;

FIG. 10 is an enlarged cross-sectional view showing the structure of the cutting tip of the cutter of a pad conditioner 5 of Example 5 according to the present invention;

FIG. 11 is an enlarged perspective view showing the surface structure of the cutting tip of the pad conditioner 5 of FIG. 10;

FIG. 12 is an enlarged cross-sectional view showing the structure of the cutting tip of the cutter of a pad conditioner 6 of Example 6 according to the present invention;

FIG. 13 is an enlarged perspective view showing the surface structure of the cutting tip of the pad conditioner 6 of FIG. 12;

FIG. 14 is an enlarged cross-sectional view showing the structure of the cutting tip of the cutter of a pad conditioner 7 of Example 7 according to the present invention;

FIG. 15 is an enlarged perspective view showing the surface structure of the cutting tip of the pad conditioner 7 of FIG. 14;

FIGS. 16A to 16D are schematic views showing a process of manufacturing the pad conditioner according to the present invention; and FIG. 17 is a photograph showing the (1,0,0) growth plane of a diamond layer formed on the cutting tip of the pad conditioner according to the present invention.

DESCRIPTION OF SPECIFIC EMBODIMENTS

Hereinafter, embodiments of the present invention will be described in detail while referring to the accompanying drawings, but the present invention is not limited thereto and may be embodied in other forms. Throughout the description, the same reference numerals are used to refer to the same or similar elements.

Furthermore, the terms used in the present invention include as much as possible general terms which are currently widely used, but, in specific cases, may include optional terms chosen by the applicant, the meanings of which should be interpreted in consideration of the meanings described or used in the present specification instead of by simply using the names of such terms.

The first technical feature of the present invention is that the structure of a cutting tip that forms a cutting surface of a CVD pad conditioner is changed, whereby friction upon conditioning is reduced and simultaneously slurry particles supplied onto a polishing pad may uniformly develop thus decreasing scratching due to the flocculation of the slurry.

Based on the fact that pressure varies depending on the depth to which the cutting tip of the pad conditioner is inserted into a polishing pad which is a conditioning target and made of an elastically deforming material such as porous resin, rubber, polyurethane rubber, etc., the pad conditioner according to the present invention is configured such that protrusion groups having two or more different uniform heights (in lieu of having only one uniform height) are disposed in a predetermined pattern, thereby reducing friction, unlike a conventional CVD pad conditioner in which the entire cutting tip of a cutter has a uniform height. Further, the distances between the protrusions can be narrowed, thereby uniformly developing slurry particles.

In order to embody the above technical features, the pad conditioner according to the present invention includes a substrate having a plurality of protrusions having different heights which are formed upwards and separated from each other by the same or different distances on part or all of one surface of the substrate, the tops of the protrusions forming a plane parallel to the surface of the substrate; and a diamond layer applied on the plurality of protrusions or on the entire surface having the protrusions. As such, the difference between the minimum height and the maximum height of the protrusion of the plurality of protrusions preferably falls in the range of 10~70 μm.

In the case where the plurality of protrusions are separated from each other by the same distance, the plurality of protrusions include two protrusion groups comprising first protrusions having a first height and second protrusions having a second height or three protrusion groups comprising first protrusions having a first height to third protrusions having a third height, in which such protrusion groups are disposed in a predetermined pattern.

In addition, in the case where the plurality of protrusions are separated from each other by different distances, the plurality of protrusions include a high height group comprising a plurality of high protrusions having a maximum first height which are formed separated by a predetermined distance, and a low height group comprising low protrusions having a height lower than the first height which are formed in a predetermined pattern in all or parts of the separation spaces between the high protrusions of the high height group, in which six or fewer low protrusions having the same or different heights per separation space are formed separated from each other, or the high height group and the low height group provide a plurality of unit groups each comprising two or more protrusions that are separated from each other, in which the plurality of unit groups may be formed such that a high height unit group and a low height unit group are alternately disposed. As such, each of the plurality of low height unit groups may have low protrusions having the same height.

Among the plurality of protrusions which form the cutting tip of the cutter of the pad conditioner according to the present invention, protrusions having the same height have the same width, but protrusions having different heights may have the same or different widths.

Also, in the case where the plurality of protrusions are separated from each other by the same distance, such a distance is preferably 0.1~2.5 mm. On the other hand, in the case where the plurality of protrusions are separated from each other by different distances, the separation distances between the high protrusions of the high height group having at least the maximum height are preferably the same as each other, in particular, 0.5~5.0 mm.

The predetermined pattern of the plurality of protrusions is specified in the examples which will be described later and in the appended drawings.

Also, the pad conditioner according to the present invention may have a variety of structures having various shapes depending on the shape of a substrate having the cutter and/or the body to which the substrate is attached, and the variety of structures of the substrate and/or the body are illustrated below.

In the present invention, the shape of the substrate is not limited so long as there is a predetermined plane on which the plurality of protrusions may be formed. For example, the substrate may have the various shapes of the cutters of known pad conditioners, including not only a polygonal or circular flat panel, but also a cup-shaped structure the surface height of the middle of one surface of which is lower than the surface height of the outer periphery thereof so that a cross-section thereof is cup-shaped (not shown in the Figures), an angled doughnut-shaped structure, or a segment structure in which a plurality of valleys that extend in a radial direction from the center is formed on the surface of the periphery of the angled doughnut-shaped structure.

However, in a typical pad conditioner including a cutter and a body, the body mainly plays a role in securely bonding the cutter thereto so that the cutter is connected to the motor rotating shaft of a conditioning device, and thus the body is not regarded as an essential element. Hence, the body of the pad conditioner according to the present invention may have various shapes, such as a cup shape, an angled doughnut shape or other shapes, so long as it is configured such that the cutter is bonded thereto so that the cutting tip of the cutter is exposed from the upper surface of a main body. Furthermore, if the pad conditioner according to the present invention is structurally changed so that the substrate thereof is directly bound to the motor rotating shaft, the body may be excluded.

The substrate on which the cutter is formed is preferably made of a known ceramic or hard metal. In particular, ceramic is preferably composed mainly of silicon carbide, silicon nitride or alumina. When the substrate is prepared using such a material, wear resistance and corrosion resistance may be imparted to the cutting tip, and the cutting ability cannot deteriorate after extended use.

In addition, the second technical feature of the present invention is that friction upon conditioning is further reduced because of the crystalline structure of the diamond layer formed on the surface of the cutting tip that forms the cutting surface of the CVD pad conditioner.

In order to reduce friction upon conditioning as much as possible, the (1,0,0) plane of the diamond layer deposited using CVD is grown, and at least the surface coating is performed using nanocrystalline diamond so that the surface in contact with the polishing pad becomes smooth, in relation to the grain size of diamond used upon coating, thereby further reducing the friction upon conditioning.

In order to embody the above technical features, the diamond layer of the pad conditioner according to the present invention is formed using CVD under conditions including a filament temperature of 1900~2000° C. and a substrate temperature of 1000~1100° C. As such, the diamond layer comprises a microcrystalline diamond coating layer having a grain size of 1~2 μm and a nanocrystalline diamond coating layer having a grain size of 0.1 μm (=100 nm) formed thereon, or is composed exclusively of a nanocrystalline diamond coating layer.

However, because the coating rate of nanocrystalline diamond is slower than the coating rate of microcrystalline diamond, the diamond layer preferably comprises a microcrystalline diamond coating layer having a thickness of 70~90% of the total thickness and a nanocrystalline diamond coating layer having a thickness of 10~30% which is the remainder of the total thickness formed on the upper surface of the microcrystalline diamond coating layer.

The diamond layer is deposited so that the thickness is actually uniform over the plurality of protrusions formed on the substrate or over the entire surface having the protrusions formed thereon. In particular, the layer thickness is set to fall in the range that imparts wear resistance to the cutting tip and neither breaks the coating layer nor causes cracks.

In addition, the third feature of the present invention is that the plurality of protrusions are formed on the substrate using a method that decreases chipping, thus increasing dimensional reproducibility and productivity.

Specifically, in the method of manufacturing the pad conditioner according to the present invention, portions of or all of the protrusions are formed on the surface of the substrate using etching, thereby enabling the formation of the upper surface of cutting tip units, namely, protrusions, without chipping.

As such, in the case where portions of the protrusions are formed using etching, it is preferred that the protrusions preferably have a height of 1~50% of the total height (h), and it is more preferred that the surface of the substrate on which the protrusions are formed be subjected to precise grinding and lapping before the protrusions are formed on the surface of the substrate.

Example 1

FIGS. 2 and 3 are respectively a cross-sectional view and a perspective view showing the enlarged structure of part of the cutting tip of the cutter of a pad conditioner 1 according to the present invention.

With reference to FIGS. 2 and 3, the cutter of the pad condition 1 is configured such that the cutter 100 includes a substrate 110, a cutting tip 120 comprising a plurality of protrusions formed upwards and separated from each other by the same distance on all of one surface of the substrate, and a diamond layer 130 formed on the entire surface of the substrate having the cutting tip formed thereon. In some cases, the cutting tip 120 may be formed only on part of the surface of the substrate 110, and a body may be bonded to the other surface of the substrate 110, and the diamond layer may be formed only on the cutting tip 120.

In the present invention, the cutting tip 120 refers to a group comprising a plurality of protrusions that respectively correspond to cutting tip units.

As shown in the drawings, the cutting tip 120 comprises a first height group 121 comprising a plurality of first protrusions 121*a* having a first height and a second height group 122 comprising a plurality of second protrusions 122*a* having a second height. In particular, the cutting tip 120 of the pad conditioner 1 has a structure in which each of the second protrusions 122 of the second height group 122 is formed such that the second protrusion 122 is disposed between a pair of first protrusions 121*a* of the first height group 121 in any direction, and thus the cutting tip units are entirely arranged separated by the same distance in the repeating sequence of "first height-second height-first height-second height". As such, the separation distance is 1.0 mm, and the difference between the first height and the second height is 50 μm.

In the drawings, the protrusions which are the cutting tip units are shown in the form of a square pillar, but the shape thereof is not limited so long as the tops thereof form a plane parallel to the surface of the substrate 110 and the lower surface thereof forms the surface of the substrate 110.

The plane parallel to the surface of the substrate 110 refers not to points but to a surface and the area thereof is not limited. All of the tops of the protrusions may define a plane parallel to the surface of the substrate 110, or only parts of the tops thereof may define a plane parallel to the surface of the substrate 110. The shape of the tops of the protrusions may be variously changed, as needed. The protrusions are preferably provided in the form of any one among truncated polypyramids, truncated cones, polyprisms, and cylinders.

As shown in the drawings, the diamond layer 130 is formed on the entire surface of the cutter 100, or may be formed only on the cutting tip 120. The technique for depositing the diamond layer 130 using CVD is known and a detailed description thereof is omitted.

As such, the pad conditioner 1 may have any known shape and thus the entire shape of the pad conditioner is not shown.

Example 2

FIGS. 4 and 5 are respectively a cross-sectional view and a perspective view showing the enlarged structure of part of the cutting tip of the cutter of a pad conditioner 2 according to the present invention.

With reference to FIGS. 4 and 5, the cutter of the pad conditioner 2 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 2 includes a first height group 121 comprising a plurality of first protrusions 121*a* having a first height and a second height group 122 comprising a plurality of second protrusions 122*a* having a second height, which are the same as in the pad conditioner 1 of Example 1. Furthermore, this cutting tip has a structure in which each of the second protrusions 122*a* of the second height group 122 is formed such that the second protrusion 122*a* is disposed between two pairs of first protrusions 121*a* of the first height group 121 in any direction, and thus the cutting tip units are entirely arranged separated by the same distance in the repeating sequence of "first height-first height-second height-first height-first height-second height". As such, the separation distance is 1.0 mm, and the difference between the first height and the second height is 50 μm.

Example 3

FIGS. 6 and 7 are respectively a cross-sectional view and a perspective view showing the enlarged structure of part of the cutting tip of the cutter of a pad conditioner 3 according to the present invention.

With reference to FIGS. 6 and 7, the cutter of the pad conditioner 3 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 3 includes a first height group 121 comprising a plurality of first protrusions 121*a* having a first height and a second height group 122 comprising a plurality of second protrusions 122*a* having a second height, which are the same as in the pad conditioner 1 of Example 1. Furthermore, this cutting tip has a structure in which each of the first protrusions 121*a* of the first height group 121 is formed such that the first protrusion 121*a* is disposed between two pairs of second protrusions 122*a* of the second height group 122 in any direction, and thus the cutting tip units are entirely arranged separated by the same distance in the repeating sequence of "second height-second height-first height-second height-second height-first height". As such, the separation distance is 1.0 mm, and the difference between the first height and the second height is 50 μm.

Example 4

FIGS. 8 and 9 are respectively a cross-sectional view and a perspective view showing the enlarged structure of part of the cutting tip of the cutter of a pad conditioner 4 according to the present invention.

With reference to FIGS. 8 and 9, the cutter of the pad conditioner 4 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 4 includes a first height group 121 comprising a plurality of first protrusions 121*a* having a first height, a second height group 122 comprising a plurality of second protrusions 122*a* having a second height, and a third height group 123 comprising a plurality of third protrusions 123*a* having a third height, and is thus different from the pad conditioners 1~3 having two height groups of Examples 1~3. However, these cutting tip units are formed separated from each other by the same distance, as in Examples 1~3. Thus, the cutting tip 120 of the pad conditioner 4 has a structure in which each of the second protrusions 122*a* of the second height group 122 and each of the third protrusions 123*a* of the third height group 123 are formed such that the second protrusion 122*a* and the third protrusion 123*a* are disposed between a pair of first protrusions 121*a* of the first height group 121 in any direction, and thus the cutting tip units are entirely arranged separated by the same distance in the repeating sequence of "first height-second height-third height-first height-second height-third height". Although not shown, the array of cutting tip units in the repeating sequence of "first height-third height-second height-first height-third height-second height" is possible. As such, the separation distance is 0.7 mm, and the difference between the first height and the second height is 30 μm, and the difference between the second height and the third height is 30 μm.

Example 5

FIGS. 10 and 11 are respectively a cross-sectional view and a perspective view showing the enlarged structure of part of the cutting tip of the cutter of a pad conditioner 5 according to the present invention.

With reference to FIGS. 10 and 11, the cutter of the pad conditioner 5 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 5 has an array of protrusions separated by different distances, unlike the pad conditioners 1~3 of Examples 1~3 having the protrusions separated by the same distance.

Specifically, a plurality of high protrusions 124*a* of a high height group 124 having a maximum first height are separated from each other by the same distance, whereas a plurality of low protrusions 125*a* of a low height group 125 having a height lower than the first height may be formed so that six or fewer low protrusions having the same or different heights per separation space between the high protrusions 124*a* of the high height group 124 are formed separated from each other by different distances. These low protrusions may also be formed on all of the separation spaces between the high protrusions 124*a*, or may be formed only on parts of the separation spaces as shown in the drawings.

In particular, the cutting tip 120 of the pad conditioner 5 has a structure in which each pair of the low protrusions 125*a* of the low height group 125 having the height (which is referred to as a "second height") lower than the first height are formed such that the two low protrusions 125*a* are disposed in parts of the separation spaces between the high protrusions 124*a* of the high height group 124 which are separated from each other by the same distance, and thus the cutting tip units are entirely arranged separated by different distances in the repeating sequence of "first height-first height-second height-second height-first height". As such, the separation distance between the high protrusions 124*a* is 2 mm, and the difference between the first height and the second height is 50 μm.

Example 6

FIGS. 12 and 13 are respectively a cross-sectional view and a perspective view showing the enlarged structure of part of the cutting tip of the cutter of a pad conditioner 6 according to the present invention.

With reference to FIGS. 12 and 13, the cutter of the pad conditioner 6 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 6 has three height groups of protrusions unlike the pad conditioners 1~3 of Examples 1~3 having only two height groups and protrusions separated by the same distance, and it has an array of protrusions separated by different distances as in the pad conditioner 5.

Specifically, the cutting tip 120 of the pad conditioner 6 has a structure in which each of low protrusions 125*b* having a second height lower than a first height and each pair of low protrusions 125*a* having a third height lower than the second height of a low height group 125 are formed such that the low protrusion 125*b* and the two low protrusions 125*a* are disposed in parts of the separation spaces between high protrusions 124*a* of a high height group 124 which are separated from each other by the same distance so as to form a protruding contour in which the center is high and both sides are low, and thus the cutting tip units are entirely arranged separated by different distances in the repeating sequence of "first height-third height-second height-third height-first height". As such, the separation distance between the high protrusions 124*a* is 2.0 mm, and the difference between the first height and the second height and the difference between the second height and the third height are each 30 μm.

Although not shown, even when five low protrusions are provided in the separation space between the high protrusions 124*a*, they are disposed to form a protruding contour in which the center is high and both sides are low as in the pad conditioner 6, which is considered to be preferable in terms of the generation of friction upon conditioning.

Example 7

FIGS. 14 and 15 are respectively a cross-sectional view and a perspective view showing the enlarged structure of part of the cutting tip of the cutter of a pad conditioner 7 according to the present invention.

With reference to FIGS. 14 and 15, the cutter of the pad conditioner 7 has the same structure as the pad conditioner 1 of Example 1, with the exception of the array of the cutting tip units of the cutting tip 120, and only the array of the cutting tip units of the cutting tip 120 is described below.

As shown in the drawings, the cutting tip 120 of the pad conditioner 7 includes a high height group 124 comprising a plurality of high protrusions 124*a* and a low height group 125 comprising a plurality of low protrusions 125*b* having the same height lower than the height of the high protrusions 124*a*, in which the high height group 124 and the low height group 125 respectively provide a plurality of unit groups 124*c*, 125*c* each comprising twelve protrusions that are separated from each other. In particular, two high height unit groups 124*c* and two low height unit groups 125*c* are alternately disposed. As such, the width and the separation distance between the protrusions of the high height unit group 124*c* and the low height unit group 125*c*, and the separation distance between the unit groups are shown to be the same. In some cases, however, the width and the separation distance may become different. Hence, the cutting tip units are entirely arranged separated by different distances in the repeating sequence of "first height group-first height group-second height group-second height group". As such, the separation distance between the high protrusions 124*a* is 1.0 mm, and the difference between the first height group and the second height group is 30 μm.

Example 8

Manufacturing of Pad Conditioner 1 of Example 1

With reference to FIGS. 16A to 16D, the method of manufacturing the pad conditioner 1 of Example 1 is specified.

As shown in FIG. 16A, portions of the surface of a substrate 110 on which protrusions will be formed are subjected to photolithography, and thus a photo mask 110*a* is formed on such a pattern.

Next, as shown in FIG. 16B, the upper portions of the pattern are formed separated by a predetermined distance using etching, so that the upper portions 121*a*, 122*a* of protrusions are provided.

Examples of the gas used for etching include $CF_4$, $CHF_3$, $SF_6$, $O_2$, $N_2$, Ar, etc. The etching usable in the present invention may be either wet etching or dry etching, and dry etching is preferable considering the etching rate.

Next, as shown in FIG. 16C, the remaining portions of the protrusions are processed thus forming a plurality of protrusions 121*a* having a uniform height.

For example, in the case where the total height (h) of the protrusions is 100 μm, portions about 1~50 μm high are formed using etching, and the remaining portions 99~50 μm high are formed using processing.

As such, processing after etching may be performed using grinding and/or cutting (hereinafter, simply referred to as "cutting"), and a cutting tool preferably used for cutting includes a cutting wheel, an end mill, a milling cutter, a drill, and a tap.

Subsequently, the plurality of protrusions 121*a* having a uniform height are polished in a predetermined pattern, so that a plurality of protrusions 121*a*, 122*a* having different heights are formed. Specifically, in order to form the pattern of the pad conditioner 1 in which a low protrusion 122*a* is formed between two high protrusions 121*a*, portions of the plurality of protrusions 121*a* having a uniform height are cut using the above cutting tool so that their height is processed, thereby forming low protrusions 122*a*.

Subsequently, the substrate having the plurality of protrusions having different heights is pretreated, and is then coated with a diamond layer. The process of coating the surface of the substrate with the diamond layer includes but is not limited to CVD. As such, the CVD process conditions are preferably controlled so that the filament temperature is set to 1900~2000° C. and the substrate temperature is set to 1000~1100° C. in order to grow a (1,0,0) plane of diamond as shown in FIG. 17.

Meanwhile, it is preferred that the surface of the substrate be subjected to precise grinding and lapping before the plurality of protrusions are formed on the substrate. Specifically, when precise grinding and lapping are performed on the surface of the substrate, the surface of the substrate is imparted with an actually uniform flatness, and both surfaces of the substrate are actually maintained parallel to each other.

As mentioned above, the cutting tip of the cutter of the pad conditioner according to the present invention includes a plurality of protrusions having different heights. Thus, when the pad conditioner according to the present invention is manufactured, etching is partially or exclusively used as above instead of using only a diamond wheel device, or a CNC which is not specified herein is partially or exclusively used, thereby obtaining a desired pattern.

Comparative Example 1

A diamond electroplated disk was manufactured by sprinkling diamond particles on a main body made of stainless steel and electroplating the diamond particles using a conventional known method.

Comparative Example 2

Using a method disclosed in Korean Patent No. 10~0387954, a CVD disk was manufactured by depositing a diamond layer using CVD on a cutter of a pad conditioner comprising truncated pyramids having almost a uniform height.

Comparative Example 3

Under CVD process conditions including a filament temperature of 1900~2000° C. and a substrate temperature of 1000~1100° C., the (1,0,0) plane of diamond was grown upon deposition of the diamond layer of Comparative Example 2, thus manufacturing a CVD disk having the (1,0,0) growth plane. The photograph of the growth plane is shown in FIG. 17.

Test Example 1

In order to measure the torque of a pad conditioner, a test for measuring the load applied to the motor of a disk arm was performed. The average torque applied to the disk rotating motor was uniform depending on the type of disk (i.e., pad conditioner) and changes in pressure, and thus the results from the type of disk and the pressure could not be checked by the average torque. However, because the torque amplitude varies depending on the type of disk and the changes in pressure, the results from the type of disk and the pressure could be checked. Specifically, as the load becomes larger, the torque range is increased. In contrast, as the load is smaller, the torque range is decreased. Thereby, the degree of load of the disk can be detected with the torque range.

Test Example 2

The torque range of each of the electroplated disk of Comparative Example 1, the CVD disk of Comparative Example 2, the disk having the (1,0,0) growth plane of Comparative Example 3, and the pad conditioner 1 of Example 1 was measured. The results are shown in Table 1 below.

TABLE 1

| | C. Ex. 1 | C. Ex. 2 | Ex. 1 | C. Ex. 3 |
|---|---|---|---|---|
| Max | 30.9 | 33.4 | 30.4 | 31.8 |
| Min | 18.7 | 16.8 | 17.5 | 18.6 |
| Range | 12.2 | 16.6 | 12.9 | 13.2 |
| Average | 24.4 | 24.4 | 22.5 | 23.5 |

As is apparent from Table 1, the pad conditioner 1 of Example 1 according to the present invention has the torque range smaller than those of the conventionally known pad conditioners, from which friction can be seen to be significantly reduced. Also, when the (1,0,0) plane of the diamond layer is grown, the torque range is small even under conditions in which the cutting tip includes protrusions that are almost uniform in height, thus effectively reducing the friction. Hence, when the cutting tip includes protrusions having different heights and the (1,0,0) plane of the diamond layer is grown, the degree to which the friction is reduced is expected to be much higher.

Test Example 3

In order to evaluate the degree of friction reduction in relation to a predetermined pattern of a cutting tip, the torque range of each of the pad conditioner 1 of Example 1, the pad conditioner 2 of Example 2, and the pad conditioner 3 of Example 3 was measured. The results are shown in Table 2 below.

TABLE 2

| | C. Ex. 2 | Ex. 1 | Ex. 2 | Ex. 3 |
|---|---|---|---|---|
| Max | 33.4 | 31.4 | 31.3 | 31.8 |
| Min | 16.8 | 17.3 | 16.3 | 16.4 |
| Range | 16.6 | 14.1 | 15 | 15.4 |
| Average | 24.4 | 23.8 | 23.7 | 25.4 |

As is apparent from Table 2, even when the pattern of the cutting tip is changed, the degree of friction reduction becomes remarkably superior compared to Comparative Example 2 having uniform protrusions. Among the pad conditioners according to the present invention, the pattern of the pad conditioner 1 of Example 1 can be more effective in friction reduction, compared to the other patterns.

Test Example 4

In order to evaluate the degree of friction reduction in relation to a difference between the first height and the second height when using a cutting tip comprising two different height groups of a plurality of protrusions, the pattern of Example 1 is provided but the height of the low cutting tip units is changed, thus manufacturing four pad conditioners in which the difference between the first height and the second height is 10 μm, 30 μm, 50 μm, and 70 μm. The torque ranges of such pad conditioners in relation to the height were measured. The results are shown in Table 3 below.

As shown in Table 3 below, as the height difference increases, the torque range tends to decrease. However, taking into consideration the conditioning effect, when the height difference is 50 μm, the optimal effect can be obtained.

TABLE 3

| | Height Difference 10 μm | Height Difference 30 μm | Height Difference 50 μm | Height Difference 70 μm |
|---|---|---|---|---|
| Max | 30.4 | 31.2 | 31.4 | 32.4 |
| Min | 17.5 | 11.5 | 17.3 | 16.6 |
| Range | 12.9 | 13.7 | 14.1 | 15.8 |
| Average | 22.5 | 23.1 | 23.8 | 23.3 |

As described hereinbefore, the present invention provides a pad conditioner having reduced friction and a method of manufacturing the same. According to the present invention, the pad conditioner is configured such that friction upon conditioning can be reduced, and thus the lifespan of a polishing pad can be prolonged.

Also in the pad conditioner according to the present invention, slurry particles supplied onto the polishing pad can be uniformly developed, and thus scratching due to the flocculation of the slurry can be decreased.

Also the pad conditioner according to the present invention is configured such that surface uniformity of the polishing pad can be ensured upon conditioning, and thus the quality of a workpiece which is processed using the polishing pad can be improved.

Also the method of manufacturing the pad conditioner according to the present invention enables the dimensional reproducibility of the pad conditioner to increase thus decreasing defective rates, and also the manufacturing rate to increase, resulting in high productivity.

Although the embodiments of the present invention have been disclosed for illustrative purposes, those skilled in the art will appreciate that a variety of different modifications, additions and substitutions are possible, without departing from the scope and spirit of the invention as disclosed in the accompanying claims. Accordingly, such modifications, additions and substitutions should also be understood as falling within the scope of the present invention.

What is claimed is:

1. A pad conditioner having reduced friction, comprising:

a substrate having a plurality of protrusions having different heights which are formed upwards and separated from each other by a same distance on part or all of one surface of the substrate, each of tops of the protrusions forming a plane parallel to the surface of the substrate; and a diamond layer disposed on the plurality of protrusions or on the entire surface having the protrusions, wherein a diamond crystalline structure of the diamond layer has a (1,0,0) growth plane, wherein the diamond layer is deposited using Chemical Vapor Deposition (CVD) under conditions including a filament temperature of 1900~2000° C. and a substrate temperature of 1000~1100° C., and wherein the plurality of protrusions comprise a first height group comprising a plurality of first protrusions having a first height, a second height group comprising a plurality of second protrusions having a second height, and a third height group comprising a plurality of third protrusions having a third height, in which the second height is lower than the first height, the third height is lower than the second height, and a difference between the first height and the second height is 10~70 μm, wherein each of the second protrusions of the second height group and each of the third protrusions of the third height group are formed such that only one of the second protrusions and only one of the third protrusions are disposed between a pair of first protrusions of the first height group in any direction.

2. The pad conditioner of claim 1, wherein the plurality of protrusions are formed separated by a distance of 0.1~25 mm.

3. The pad conditioner of claim 1, wherein the difference between the first height and the second height is 30 μm and the difference between the second height and the third height is 30 μm.

4. A method of manufacturing the pad conditioner having reduced friction, the pad conditioner comprising:

a substrate having a plurality of protrusions having different heights which are formed upwards and separated from each other by a same distance on part or all of one surface of the substrate, each of tops of the protrusions forming a plane parallel to the surface of the substrate; and a diamond layer disposed on the plurality of protrusions or on the entire surface having the protrusions, wherein a diamond crystalline structure of the diamond layer has a (1,0,0) growth plane, wherein the diamond layer is deposited using Chemical Vapor Deposition (CVD) under conditions including a filament temperature of 1900~2000° C. and a substrate temperature of 1000~1100° C., and wherein the plurality of protrusions comprise a first height group comprising a plurality of first protrusions having a first height, a second height group comprising a plurality of second protrusions having a second height, and a third height group comprising a plurality of third protrusions having a third height, in which the second height is lower than the first height, the third height is lower than the second height, and a difference between the first height and the second height is 10~70 μm, wherein each of the second protrusions of the second height group and each of the third protrusions of the third height group are formed such that only one of the second protrusions and only one of the third protrusions are disposed between a pair of first protrusions of the first height group in any direction, the method comprising:

preparing a substrate;

forming a plurality of protrusions having a uniform height and separated from each other by a predetermined distance on a surface of the substrate, each of tops of the protrusions forming a plane parallel to the surface of the substrate;

polishing the plurality of protrusions having the uniform height in a predetermined pattern so that the plurality of protrusions have different heights; and coating the surface of the substrate having the plurality of protrusions having different heights with a diamond layer, wherein the forming the plurality of protrusions is performed using a first step of etching and a second step comprising any one among an end mill, a milling cutter, a drill and a tap; the polishing the plurality of protrusions is performed using any one among an end mill, a milling cutter, a drill and a tap; and the coating is performed using CVD, wherein the diamond layer comprises a microcrystalline diamond coating layer having a thickness of 70~90% of a total thickness and a nanocrystalline diamond coating layer having a thickness of 10~30% which is a remainder of the total thickness formed on an upper surface of the microcrystalline diamond coating layer, and wherein the second step further comprises, when part of the height of the protrusions is formed, forming the remaining height of the protrusions using any one among a cutting wheel, an end mill, a milling cutter, a drill and a tap.

5. The method of claim 4, wherein subjecting at least one surface of the substrate to precise grinding and lapping is performed, before forming the protrusions.

6. The method of claim 4, wherein the difference between the first height and the second height is 30 μm and the difference between the second height and the third height is 30 μm.

* * * * *